US005779764A

United States Patent [19]

Gillen et al.

[11] Patent Number: 5,779,764

[45] Date of Patent: Jul. 14, 1998

[54] METHOD FOR OBTAINING DEVOLATILIZED BITUMINOUS COAL FROM THE EFFLUENT STREAMS OF COAL FIRED BOILERS

[75] Inventors: James E. Gillen, Tallmadge; Richard E. Mills, Akron, both of Ohio

[73] Assignee: Carbon Plus, L.L.C., Akron, Ohio

[21] Appl. No.: 779,931

[22] Filed: Jan. 6, 1997

[51] Int. Cl.[6] ..... B03C 3/04

[52] U.S. Cl. ..... 95/79; 96/75; 110/345

[58] Field of Search ..... 95/79–81, 26; 96/25, 75, 77, 80; 110/216, 345, 347, 229

[56] References Cited

U.S. PATENT DOCUMENTS

| | | | |
|---|---|---|---|
| Re. 32,767 | 10/1988 | Jonelis | 96/72 |
| 2,675,092 | 4/1954 | Hall | 96/20 |
| 2,785,769 | 3/1957 | Pollock | 95/70 |
| 3,048,955 | 8/1962 | Little | 95/6 |
| 3,086,341 | 4/1963 | Brandt | 96/34 |
| 4,008,057 | 2/1977 | Gelfand et al. | 96/25 |
| 4,186,669 | 2/1980 | Cowan et al. | 110/229 X |
| 4,209,306 | 6/1980 | Feldman et al. | 95/80 |
| 4,284,417 | 8/1981 | Reese et al. | 95/3 |
| 4,308,036 | 12/1981 | Zahedi et al. | 95/68 |
| 4,479,813 | 10/1984 | Jonelis | 96/72 |
| 4,690,694 | 9/1987 | Alig et al. | 95/3 |
| 4,932,337 | 6/1990 | Breen et al. | 110/347 |
| 4,960,059 | 10/1990 | Berkau et al. | 110/347 |
| 5,439,513 | 8/1995 | Periasamy et al. | 96/25 |

*Primary Examiner*—Richard L. Chiesa

*Attorney, Agent, or Firm*—Renner, Kenner, Greive, Bobak, Taylor & Weber

[57] ABSTRACT

A method for obtaining devolatilized coal, utilizing a multi-zone electrostatic precipitator, from the air-borne effluent streams of coal fired boilers includes the steps of directing an effluent stream, generated by the combustion of coal and carrying a plurality of particles including carbon and ash, to an electrostatic precipitator, wherein the plurality of particles include first and second pluralities of particles including a first plurality of particles having a greater carbon to ash weight ratio than the second plurality of particles; de-energizing a first zone of the electrostatic precipitator and collecting a plurality of particles that exit the precipitator from the first zone, the plurality of particles collected at the first zone being substantially composed of the first plurality of particles.

13 Claims, 1 Drawing Sheet

METHOD FOR OBTAINING DEVOLATILIZED BITUMINOUS COAL FROM THE EFFLUENT STREAMS OF COAL FIRED BOILERS

TECHNICAL FIELD

This invention relates to a method for selectively capturing carbonaceous material from the effluent stream of a coal fired boiler. More specifically, the present invention provides a method whereby the electrical field within an electrostatic precipitator is manipulated so as to selectively capture high concentrations of carbonaceous material. The present invention also relates to anthracite material that is obtained by the method of the present invention.

BACKGROUND OF THE INVENTION

Utilities and industrial boiler operators produce steam by burning fossil fuels that generate heat to boil water circulating through tubes. The steam is typically used to drive generators and produce electricity. Although steam is the intermediate product that is required to ultimately produce power, combustion byproducts also result from the burning of fossil fuels such as coal.

Two types of large utility coal fired boilers are common in the art. One is a pulverized coal fired boiler, which utilizes powdered coal suspended in a gaseous stream. The other, commonly referred to as a cyclone boiler, utilizes larger particles of coal typically no greater than about ⅛ of an inch.

In addition to the normal products of combustion resulting from the burning of fossil fuels, the effluent stream from a coal fired boiler also contains particulate emissions. These emissions generally include carbonaceous material and ash. The carbonaceous material is very low in volatiles or hydrocarbons, and the ash is typically comprised of $SiO_2$, $Al_2O_3$, CaO and $Fe_2O_3$.

The particulate matter is typically collected from the effluent stream of coal fired boilers using particulate control equipment that is installed downstream from the boilers. The purpose of the particulate control equipment is to clean the flue gas or effluent stream prior to its exit from the plant and into the atmosphere.

Particulate control equipment includes, among others, electrostatic precipitators, fabric filters, mechanical collectors and venturi scrubbers. Electrostatic precipitators are commonly employed by the utility industry for the removal of particulates. Electrostatic precipitators electrically charge particulate matter in the flue gas stream, and the charged particles are then attracted to an oppositely charged plate where the particles are collected. An example of an electrostatic precipitator is described in U.S. Pat. No. 4,479,813.

These precipitators are typically designed to allow the flue gas to pass through a series of electrodes and vertical plates. The electrodes and plates are connected to a conventional power source. As is well known in the art, the power source creates an electrostatic charge on the electrodes and an opposite electrostatic charge on the plates so that solid particles carried by the effluent stream are charged by electrodes and attracted to the plates.

More specifically, each particle within the effluent stream is imparted with a negative charge and is subsequently retained on a positively charged plate. Typically, collection of the particulates occurs with successive steps. Successive steps or stages are often necessitated by the fact that as the negatively charged particles move across the plates, some particles may be more difficult to charge than others, and some particles may lose their charge and require recharging. Gas velocity may also impact the efficiency of the collection process. Lower velocities may allow more time for the charged particles to adhere to the plates and reduce the likelihood of re-entrainment in the flue gas.

Electrostatic precipitators are sized to meet a required collection efficiency, and many variables impact the precipitator's efficiency. These factors include, among others, the size of the collection plate, the gas flow velocity, the fuel and ash characteristics, and the boiler operating conditions. These variables can act independently or compound the relationship of other variables on collection efficiency. For example, ash characteristics can have an effect on migration velocity and/or resistivity to the plates, which is also affected by gas temperatures. Temperatures typically impact volumes, which in turn effect velocity.

Because of the chemical characteristics of the ash, the particulate material is typically collected and marketed to the concrete industry. The carbonaceous material, however, is not desired in such applications. Moreover, the carbonaceous material can be marketed separately to other industries.

It is therefore highly desirable to selectively capture and collect the carbonaceous material from the ash.

SUMMARY OF INVENTION

It is therefore, an object of the present invention to selectively capture high concentrations of carbon exhibiting the characteristics of anthracite coal from the effluent stream of coal fired boilers.

It is another object of the present invention to devise a method to control the precipitates within the effluent stream of coal fired boilers in such a manner so as to capture marketable anthracite-like material.

It is yet another object of the present invention to improve the efficiency of an electrostatic precipitator by separating the larger particles from the smaller particles and subsequently removing the smaller particles downstream in the precipitator.

It is still a further object of the present invention to selectively capture high concentrations of non-carbon ash from the effluent stream of coal fired boilers.

At least one or more of the foregoing objects, together with the advantages thereof over the known art, which shall become apparent from the specification which follows, are accomplished by the invention as hereinafter described and claimed.

In general the present invention provides a method for obtaining devolatilized coal, utilizing a multi-zone electrostatic precipitator, from the airborne effluent streams of coal fired boilers comprises the steps of directing an effluent stream, generated by the combustion of coal and carrying a plurality of particles comprising carbon and ash, to an electrostatic precipitator, wherein the plurality of particles comprise first and second pluralities of particles said first plurality of particles having a greater carbon to ash weight ratio than the second plurality of particles; de-energizing a first zone of the electrostatic precipitator and collecting a plurality of particles that exit the precipitator from the first zone, the plurality of particles collected at the first zone being substantially comprised of the first plurality of particles.

The present invention also includes a by-product of burning coal within a boiler comprising devolatilized carbon exhibiting the characteristics of anthracite coal, which is obtained by directing an effluent stream, generated by the combustion of coal and carrying a plurality of particles comprising carbon and ash, to an electrostatic precipitator, wherein the plurality of particles comprise first and second pluralities of particles said first plurality of particles having a greater carbon to ash weight ratio than the second plurality of particles; de-energizing a first zone of the electrostatic precipitator and collecting a plurality of particles that exit the precipitator from the first zone, the plurality of particles collected at the first zone being substantially comprised of the first plurality of particles.

The present invention also includes a method for obtaining devolatilized coal, utilizing a multi-zone electrostatic precipitator, from the airborne effluent streams of coal fired boilers comprising the steps of directing an effluent stream, generated by the combustion of coal and carrying a plurality of particles comprising carbon and ash, to an electrostatic precipitator, wherein the plurality of particles comprise first and second pluralities of particles, the first plurality of particles having a greater carbon to ash weight ratio than the second plurality of particles; de-energizing at least one zone of the electrostatic precipitator and collecting a plurality of particles that exit the precipitator from the zone, the plurality of particles collected at the zone having a lower ash content than if the field had been energized.

PREFERRED EMBODIMENT FOR CARRYING OUT THE INVENTION

Figure 1:
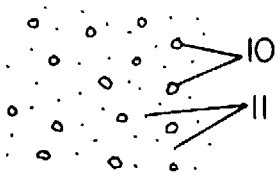
FIG. 1 is a schematic depiction of the particulate matter within the effluent stream of a coal fired boiler.

The present invention is generally directed toward a method for selectively capturing carbonaceous material from the air-borne effluent stream of coal fired boilers. This method generally takes advantage of the behavior of the various particulates within the emission stream. It should be understood that although reference is made to the effluent stream of coal fired boilers, any effluent stream from any coal fired apparatus is contemplated.

As generally discussed above, the effluent stream or flue gas leaving a coal fired boiler contains the normal products of combustion resulting from fossil fuels, as well as particulate matter including ash, residual elements, and carbonaceous material, i.e. un-oxidized carbon. The ash generally includes $SiO_2$, $Al_2O_3$, CaO and $Fe_2O_3$. The residuals elements can include, but are not limited to, sulfur. The carbonaceous material is mostly elemental carbon with residual hydrocarbon, and for purposes of this specification may simply be referred to as carbon. To facilitate explanation of the present invention, reference will simply be made to the carbon and the ash with the understanding that a portion of the ash content is associated directly with the carbon particle e.g., about 12 percent by weight, while the remaining ash (up to about 88 percent) is free, that is, traveling as particles separate from the carbon.

The particulate material within the effluent stream generally ranges in size from about 0.02 to about 6.0 mm in diameter. There is a direct relationship between particle size and the ratio of carbon to ash. In other words, as the particle size increases, the weight percent of carbonaceous material to weight percent of ash increases.

Although the carbon content of any given particle within the effluent stream of a coal fired boiler can vary for a variety of reasons, the particles within the effluent stream of a coal fired boiler can generally be characterized as follows. Particles having a diameter between about 1 and 6 mm generally contain greater than about 75 percent by weight carbon. Particles having a diameter between about 0.2 and about 1 mm in diameter generally contain between about 30 and about 75 percent by weight carbon. Particles having a diameter between about 0.07 and about 0.2 mm in diameter generally contain between about 15 about 30 percent by weight carbon. And, particles having a diameter less than about 0.07 mm generally contain less than about 15 percent by weight carbon. It should be understood that the remaining weight of any given particle is comprised of ash and only trace amounts of residuals.

For purposes of explaining the present invention, reference will be made to two pluralities of particles, the first plurality are those particles having a weight ratio of carbon to ash of at least about 1:1. It should be appreciated these particles are larger in size than the second plurality of particles, which are those particles having a smaller weight ratio of carbon to ash, and which are not included in the first plurality. The second plurality of particles also includes the free ash particles, those having little to no carbon.

Preferably, the particles of the first plurality have a carbon to ash weight ratio greater than 2:1; more preferably a carbon to ash weight ratio greater than 3:1 and most preferably, a carbon to ash weight ratio greater than 4:1. Accordingly, the first plurality may be referred to as the larger particles and the second plurality may be referred to as the smaller particles. With reference to FIG. 1, the larger particles 10 are depicted within an effluent stream also containing smaller particles 11. It should be appreciated that there are more than two sizes of particles within the effluent stream, although only two sizes have been depicted so as to facilitate explanation of the invention.

It has recently been discovered that the carbonaceous material found in the effluent stream of coal fired boilers exhibits the characteristics of anthracite coal. Anthracite is that coal material that is low in volatile material, as opposed to a more highly volatile bituminous material. Such anthracite-like material is referred to in the art as devolatilized bituminous coal (DBC). Because of its low volatility, anthracite is a highly marketable material, especially in uses such as steel purification and processing.

According to the method of the present invention, it has unexpectedly been found that highly concentrated amounts of carbonaceous material can be selectively collected from an effluent stream of a coal fired boiler by "de-energizing" the first collection zone of an electrostatic precipitator. De-energizing the first collection zone allows the larger particles, i.e. those having a larger concentration of carbon, to fall from the effluent stream and be collected.

An electrostatic precipitator (ESP) will refer to any of a variety of airborne particulate collection systems that create an electrostatic field for the purpose of imparting a charge on air-borne particulate, and provide a ground or oppositely charged region to which the charged particles are attracted. Those of skill in the art will appreciate that this definition includes small-scale ESPs that operate on less than 50 megawatts of power, as well as the larger ESPs that operate on greater than 500 megawatts of power. As will become apparent hereinbelow, ESPs generally have a series of collection zones, each of which contain at least one electric field or family of fields having the same source of power, and a collection means such as a hopper.

For purposes of this specification, de-energize will refer to powering down the one or more electrical fields within a collection zone of an ESP to about 50 percent or less of its electrical capacity. Preferably, de-energize will refer to decreasing to power within such electric field to about 25 percent or less of its electrical capacity. Most preferably, de-energize will refer to "turning-off" the electrical power to such electric field.

The ESPs employed to carry out the method of the present invention will include those ESPs that have more than one collection zone. As explained above, most ESPs used for particulate collection in utility type boilers have multiple collection zones for maximum particulate collection before discharge of the effluent stream into the environment. Those of skill in the art will appreciate that such a multi-zone ESP is necessary when performing the method of the present invention inasmuch as the smaller particles, i.e. those having a higher concentration of ash, will not exit the ESP at the de-energized zone, and, if it is desirous to remove such particles, at least one subsequent energized field will be needed for purposes of collecting such smaller particles.

Figure 2:
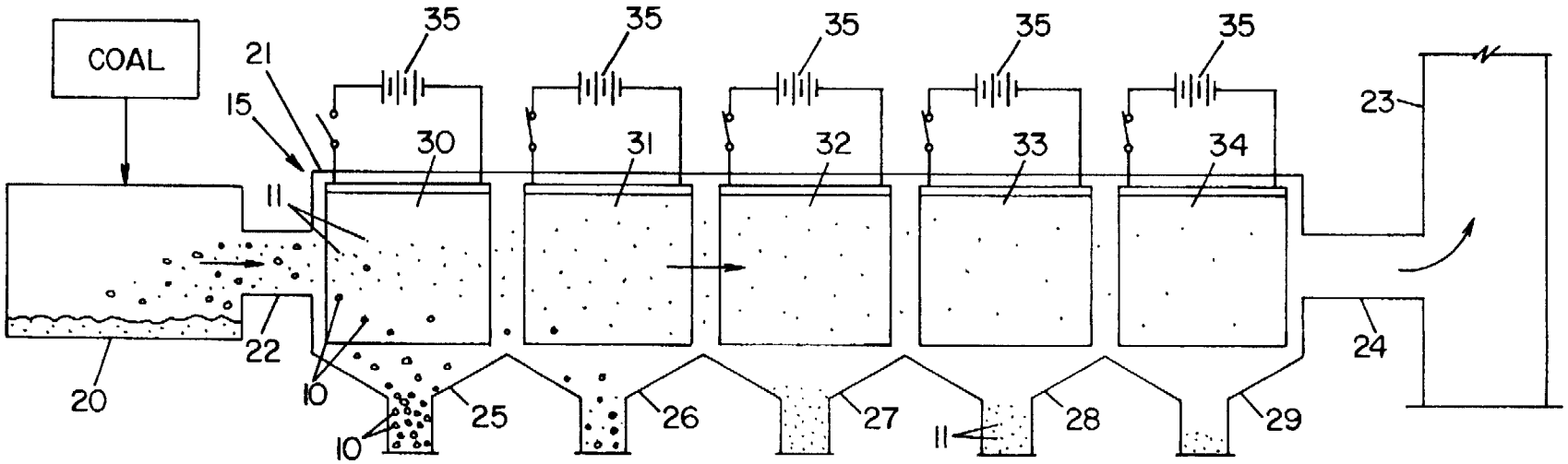
FIG. 2 is a schematic depiction of the present invention being practiced in a conventional electrostatic precipitator downstream from a coal fired boiler.

The method of the present invention is best described with reference to FIG. 2, which depicts a conventional electrostatic precipitator 15 having housing 21 connected to boiler 20 via inlet duct 22. The housing is enclosed and has its outlet connected to smokestack 23 via outlet duct 24. The bottom of housing 21 includes a plurality of collector hoppers 25, 26, 27, 28 and 29, which are adapted to receive the solid particles that are collected on the plates associated with their respective electric fields. The hoppers can be opened at their respective bottoms to discharge the collected solid particles from the housing into a storage means or a conveying system.

The electrostatic precipitator 15 further includes electric fields 30, 31, 32, 33 and 34, each connected to a power source 35. It should be understood that an electrical field such as 30 and its associated collection means 25 define a collection zone. Although not shown, it should be understood that each respective electric field contains at least one electrode and at least one plate connected to a power source 35. The source 35 creates an electrostatic charge on the electrodes and an opposite electrostatic charge on the plates so that particulate, such as large particles 10 and small particles 11, carried by the effluent stream are attracted to the plates when the field is charged. Inasmuch as both large particles 10 and small particles 11 are charged and attracted to the plates, there is no particle selection occurring under normal operating procedure. Moreover, it is believed that the charged particles are attracted to each other within the electric field, thereby causing the large particles 10 and small particles 11 to conglomerate and be collected together.

Pursuant to the method of the present invention, electric field 30, which is in the first zone, is de-energized. Unexpectedly, the elimination of electrostatic charge in field 30 allows a greater quantity of larger particles 10 to fall from the effluent stream. The product collected at hopper 25, which is substantially comprised of large particles, with some smaller particles 11 (not shown), includes a greater amount of carbon than would be collected if the first zone were energized and consequently, a lower ash content. By substantially comprised of large particles, it is meant that the particulate by-product captured at a first de-energized zone should contain greater than about 50 percent by weight carbon, preferably about 60 percent by weight carbon, and most preferably about 75 percent by weight carbon. The majority of the smaller particles 11 proceed through electrostatic precipitator 15 toward charged electric fields 31, 32, 33 and 34 where they are ultimately collected in hoppers 26, 27, 28 and 29, respectively.

It should be understood that the first zone refers to that zone of the ESP that is first contacted by the effluent stream, and that zone where collection takes place. Accordingly, the first zone may refer to a second, third or even fourth zone of a five zone ESP if there is no collection occurring at the previous zones.

Furthermore, it should be understood that the first zone can include more than one electrical field, in which case every electrical field within the first zone must be de-energized. This situation would occur where one collection means or hopper services more than one electrical field. Likewise, it should be understood that the first zone can include more than one hopper where multiple hoppers service one electrical field.

It should be appreciated that the efficiency of the method of the present invention increases as the energy supplied to the first zone approaches zero, i.e. turned-off, because conglomeration of the particles is reduced where the electrostatic field is eliminated.

It should also be appreciated that by the removal of the larger particles at the first zone, the removal efficiency of the subsequent zones is improved. Without wishing to be bound by any particular theory, it is believed that the particulate removal efficiency of subsequent zones is improved because the removal of the larger particles in the first zone increases the surface area of the particles traveling into subsequent zones. Accordingly, less energy is required in the subsequent zones to achieve the desired particulate removal. The by-product captured at these subsequent charged zones is also selectively captured inasmuch as the effluent stream primarily comprises smaller particles subsequent to the first zone. The smaller particles, separated from a majority of the larger particles, are desirous to the concrete industry.

It is also within the present invention to de-energize a field of the ESP after an energized field through which the effluent stream is passed. Although the concentration of larger particles 10 will be diminished, we have found that amount by weight of ash is greatly reduced even in a downstream field by deenergizing that field as compared to the product collected when the field is energized. Lower or reduced ash contents of at least 80 percent by weight and up to about 90 percent by weight are possible. This aspect may be important where a different analysis of product is desired or useful than that which is obtained by de-energizing the very first field of the ESP.

GENERAL EXPERIMENTAL

In order to demonstrate practice of the present invention, ash was collected from the first hopper of an electrostatic precipitator while the first electric field was energized and when the first electric field was de-energized. The effluent stream was generated from a cyclone coal boiler utilizing bituminous coal having an average particle size between about 0.01 and about 6 mm in diameter. The coal had a BTU content of about 12,000 BTU/lb on an as received basis, and an ash content of about 12 percent by weight. The electrostatic precipitator was a Wheelabrator Frye 108 megawatt ESP. This boiler arrangement typically burns between about 750 and 1,000 tons of coal per day; and employing the method of the present invention can produce between about 8,000 and about 10,000 lbs of carbonaceous material per day.

Table 1 below summarizes the characteristics of the ash collected.

TABLE I

QUALITY COMPARISON: PRECEPITATOR FIELD 30 ASHES

| Parameter | Field 30 On | Field 30 Off |
|---|---|---|
| Proximate Analysis | | |
| % Moisture | 0.2% | 0.1% |
| % Ash | 55% | 16% |
| % Sulfur | 1.2% | |
| BTU/Lb. | 6100 | 11500 |
| Ultimate Analysis | | |
| % Carbon | 41% | 82% |
| % Hydrogen | 0.1% | 0.3% |
| % Nitrogen | 0.3% | 0.9% |
| % Oxygen | 1.0% | 0% |
| Sieve Size | | |
| % Passing 50 mesh | 90% | 13% |
| % Passing 200 mesh | 55% | 3% |
| Loss on Ignition | 42% | 83% |
| Volatiles | 4.7% | 1.1% |
| Density | 45/cu.ft. | 28/cu.ft. |
| Ash Mineral Components | | |
| $SiO_2$ | 42.9% | 47.8% |
| $Al_2O_3$ | 23.0% | 28.5% |
| $Fe_2O_3$ | 22.9% | 18.4% |
| CaO | 2.6% | 1.9% |

As represented in Table 1, the carbon content of the ash recovered from the first zone nearly doubled when it was de-energized. Specifically, the ash that was captured from the de-energized zone contained about 82 percent carbonaceous material and about 16 percent ash and about 2 percent residuals. Although the chemical characteristics of the ash was relatively similar under both circumstances, the percentage of large particles captured from the de-energized zone was greater than the percentage captured when the zone was energized. Namely, only about 13 percent of the carbonaceous material passed a 50 mesh and only about 3 percent passed a 200 mesh. Moreover, the carbonaceous material that was captured from the de-energized field included only about 1.1 percent volatile matter, as opposed to 4.7 percent which was the amount of volatile matter captured while the field was energized.

Thus it should be evident that the method of the present invention is highly effective in capturing high concentrations of carbonaceous material from the effluent stream of coal fired boilers. The invention is particularly suited for coal fired boilers, especially those which are cyclone type boilers, but is not necessarily limited thereto. Specifically, the method can be employed to capture greater concentrations of carbonaceous material from the effluent stream of pulverized coal fired boilers. It should also be understood that the method of the present invention can be used exclusively, or with other means or equipment for removing particulate or other matter from an effluent stream. Furthermore, it should be understood that the method can be modified so as to de-energize the second field of a multi-zone ESP and thereby capture a third plurality of particles, those that did not exit the effluent stream at the first zone and are not small enough to continue in the effluent stream toward a subsequent energized field.

Based upon the foregoing disclosure, it should now be apparent that the use of the method described herein will carry out the objects set forth hereinabove. It is, therefore, to be understood that any variations evident fall within the scope of the claimed invention and thus, the selection of specific component elements or steps can be determined without departing from the spirit of the invention herein disclosed and described. In particular, the second field of an electrostatic precipitator can also be de-energized to further capture carbonaceous material. Thus, the scope of the invention shall include all modifications and variations that may fall within the scope of the attached claims.

What is claimed is:

1. A method for obtaining devolatilized coal, utilizing a multi-zone electrostatic precipitator, from the air-borne effluent streams of coal fired boilers comprising the steps of:

directing an effluent stream, generated by the combustion of coal and carrying a plurality of particles comprising carbon and ash, to an electrostatic precipitator, wherein said plurality of particles comprise first and second pluralities of particles said first plurality of particles having a greater carbon to ash weight ratio than said second plurality of particles;

de-energizing a first zone of said electrostatic precipitator and collecting a plurality of particles that exit said precipitator from said first zone, said plurality of particles collected at said first zone being substantially comprised of said first plurality of particles.

2. A method according to claim 1, wherein said first plurality of particles comprise greater than 50 percent by weight carbon.

3. A method according to claim 1, wherein said first plurality of particles comprise greater than 75 percent by weight carbon.

4. A method according to claim 1, wherein said first plurality of particles have a diameter between about 1 and about 5 mm.

5. A method according to claim 1, further comprising the step of directing said effluent stream to an energized zone, thereby collecting said second plurality of particles.

6. A method according to claim 1, wherein said plurality of particles that exit said precipitator at said first zone comprise greater than about 50 percent by weight carbon.

7. A method according to claim 1, wherein said plurality of particles that exit said precipitator at said first zone comprise greater than about 60 percent by weight carbon.

8. A method for obtaining devolatilized coal, utilizing a multi-zone electrostatic precipitator, from the air-borne effluent streams of coal fired boilers comprising the steps of:

directing an effluent stream, generated by the combustion of coal and carrying a plurality of particles comprising carbon and ash, to an electrostatic precipitator, wherein said plurality of particles comprise first and second pluralities of particles, said first plurality of particles having a greater carbon to ash weight ratio than said second plurality of particles;

de-energizing at least one zone of said electrostatic precipitator and collecting a plurality of particles that exit said precipitator from said zone, said plurality of particles collected at said zone having a lower ash content than if said field had been energized.

9. A method according to claim 8, wherein said ash content of said plurality of collected particles is at least 80 percent by weight lower.

10. A method according to claim 8, wherein said ash content of said plurality of collected particles is at least 90 percent by weight lower.

11. A method according to claim 8, wherein said zone receives said effluent stream having passed through at least one previous zone of said electrostatic precipitator, said previous zone being energized.

12. A method according to claim 11, further comprising the step of directing said effluent stream to a second energized zone.

13. A method according to claim 12, further comprising the step of directing said effluent stream to a second de-energized zone.

* * * * *